US007117556B2

(12) United States Patent
Grey

(10) Patent No.: US 7,117,556 B2
(45) Date of Patent: Oct. 10, 2006

(54) SURFACE CLEANING APPARATUS

(75) Inventor: Nicholas Gerald Grey, 7 Laxton Close, Crowle, Worcestershire WR7 4BH (GB)

(73) Assignee: Nicholas Gerald Grey, Crowle (GB)

( * ) Notice: Subject to any disclaimer, the term of this patent is extended or adjusted under 35 U.S.C. 154(b) by 331 days.

(21) Appl. No.: 10/431,783

(22) Filed: May 8, 2003

(65) Prior Publication Data

US 2004/0221406 A1 Nov. 11, 2004

(51) Int. Cl.
*A47L 11/24* (2006.01)

(52) U.S. Cl. ..... 15/41.1; 15/42; 15/420

(58) Field of Classification Search ..... 15/41.1, 15/42, 82, 83, 52.1, 52.3, 79.1, 79.2, 415.1, 15/420, 375
See application file for complete search history.

(56) References Cited

U.S. PATENT DOCUMENTS

| | | | | |
|---|---|---|---|---|
| 282,957 | A * | 8/1883 | Carter | 15/41.1 |
| 2,166,977 | A * | 7/1939 | Smith | 15/41.1 |
| 2,208,516 | A * | 7/1940 | Parrish | 15/41.1 |
| 2,228,528 | A * | 1/1941 | Miller | 15/41.1 |
| 2,235,432 | A | 3/1941 | Kenyon | |
| 2,635,269 | A * | 4/1953 | Smith | 15/41.1 |
| 3,184,775 | A | 5/1965 | Downey et al. | |
| 3,460,188 | A | 8/1969 | Boyd | |
| 3,482,276 | A * | 12/1969 | Fillery | 15/349 |
| 3,906,585 | A * | 9/1975 | Mattsson | 15/349 |
| 3,978,539 | A | 9/1976 | Yonkers et al. | |
| 4,099,284 | A | 7/1978 | Shinozaki et al. | |
| 4,177,533 | A | 12/1979 | Liebscher et al. | |
| 4,219,902 | A * | 9/1980 | DeMaagd | 15/364 |
| 4,369,539 | A * | 1/1983 | Nordeen | 15/52.1 |
| 4,457,042 | A | 7/1984 | Jones et al. | |
| 4,993,108 | A | 2/1991 | Genge et al. | |
| 5,101,534 | A | 4/1992 | Watanabe et al. | |
| 5,224,232 | A | 7/1993 | Zahuranec et al. | |
| 5,379,483 | A | 1/1995 | Pino | |
| 5,617,611 | A | 4/1997 | Worwag | |
| 5,765,258 | A | 6/1998 | Melito et al. | |
| 5,896,611 | A | 4/1999 | Haaga | |
| 5,920,939 | A * | 7/1999 | Worwag | 15/41.1 |
| 6,094,776 | A * | 8/2000 | Fish | 15/398 |

FOREIGN PATENT DOCUMENTS

| | | |
|---|---|---|
| DE | 18 14 398 | 9/1970 |
| DE | 7203819 | 7/1972 |
| DE | 2239135 | 2/1974 |
| DE | 196 01 976 | 7/1997 |
| DE | 199 14 574 | 11/2000 |
| EP | 0 285 096 | 10/1988 |
| EP | 1 319 758 A2 | 6/2003 |
| FR | 2 228 459 | 12/1974 |
| FR | 2778079 | 11/1999 |
| GB | 1 533 494 | 7/1975 |

(Continued)

OTHER PUBLICATIONS

International Search Report dated Aug. 25, 2004 for Application No. EP 04 01 1243.

(Continued)

*Primary Examiner*—Gary K. Graham
(74) *Attorney, Agent, or Firm*—Womble Carlyle

(57) ABSTRACT

A surface cleaning apparatus comprising a body (1) with a front face (201) wherein the front face (201) comprises a non-planar lower edge (203) such that in use the distance between the lower edge (203) and a plane of a surface to be cleaned is not uniform.

16 Claims, 7 Drawing Sheets

FOREIGN PATENT DOCUMENTS

| | | |
|---|---|---|
| GB | 1 442 587 | 7/1976 |
| GB | 1 547 286 | 6/1979 |
| GB | 2 137 486 | 10/1984 |
| GB | 2 318 279 | 4/1998 |
| GB | 2351435 A | 1/2001 |
| JP | 49-55164 | 5/1974 |
| JP | 52-43378 | 9/1975 |
| JP | 55-96126 | 7/1980 |
| JP | 4322625 | 11/1992 |
| JP | 10-201682 | 1/1997 |
| JP | 11-276392 | 10/1999 |
| JP | 1999-0078370 | 10/1999 |
| WO | WO 03/024292 | 3/2003 |

OTHER PUBLICATIONS

International Search Report dated Aug. 25, 2004 for Application No. EP 04 01 1244.

* cited by examiner

SURFACE CLEANING APPARATUS

This invention relates to a surface cleaning apparatus, such as for a floor or upholstery.

DESCRIPTION OF PRIOR ART

Surface cleaning apparatus which do not use suction, for example, sweeper type floor cleaning apparatus using rotatable brushes to pick up and collect particles and other debris, have a leading front face of the body of the sweeper apparatus, with a substantially planar lower edge such that, in use, a required clearance distance, for example 10 mm, is maintained between the lower edge of the body of the sweeper apparatus and the surface to be cleaned.

If the clearance distance between the lower edge of the sweeper apparatus and the surface to be cleaned is too small, debris will accumulate in front of the lower edge of the front face of the sweeper apparatus and will be prevented from passing under the lower edge and being swept up by the bristles of brushes within the body of the apparatus.

However, if the clearance distance between the lower edge of the sweeper apparatus and the surface to be cleaned is too great, turbulence caused by the rotation of the bristles can cause debris to be pushed along in front of the sweeper apparatus as the sweeper apparatus is pushed forward. As the clearance between the lower edge of the body of the sweeper and the surface to be cleaned is increased, the efficiency of the sweeper apparatus in picking up and collecting debris is reduced.

However, the size of particles or other debris on a surface to be cleaned can vary. A sweeper apparatus with a clearance, for example 10 mm between the lower edge of the front face of the apparatus and the surface to be cleaned, suitable for the majority of pieces of debris routinely found on a surface to be cleaned would not allow debris larger than 10 mm in height to pass under the leading edge of the body of the sweeper apparatus and be picked up. At present, if the larger pieces of debris are to be removed from the surface to be cleaned are larger than the clearance between the lower edge and the surface to be cleaned, it is necessary either to pick up the debris by hand, or to raise the body of the sweeper apparatus away from the surface to be cleaned and replace it over the larger debris.

Therefore, there is a need for a sweeper apparatus which is adapted to be able to efficiently pick up nominally average sized debris but which can also pick up relatively larger debris without the need to remove the sweeper apparatus from the surface to be cleaned.

OBJECT OF THE INVENTION

It is therefore an object of the present invention to provide a surface cleaning apparatus which overcomes, or at least ameliorates, at least some of the problems of known apparatus.

SUMMARY OF THE INVENTION

According to the present invention there is provided a surface cleaning apparatus comprising a body with a front face wherein the front face comprises a non-planar lower edge such that in use the distance between the lower edge and a plane of a surface to be cleaned is not uniform.

The front face may have at least one recess open at the lower edge.

The at least one recess may have a width in a range from 20 mm to 150 mm, preferably a width of 60 mm.

The at least one recess may have a depth in a range from about 4 mm to about 20 mm, preferably a depth of about 10 mm.

An embodiment of a surface cleaning apparatus incorporating a front face comprising a non-planar lower edge may comprise a body comprising a rear compartment, a forward compartment and an intermediate compartment arranged between the rear and forward compartments; the elongate rotatable brush arrangement positioned within and extending across the forward compartment; an electric motor positioned in the rear compartment; and drive means extending between the rotatable brush arrangement and the electric motor.

A battery, such as a rechargeable battery, may be positioned in the rear compartment together with the electric motor. Alternatively, the electric motor may be mains powered.

The rotatable brush arrangement may extend substantially the entire width of the forward compartment.

The intermediate compartment may be provided with a removable closure, such as a removable side wall or a removable tray, for the removal of debris therefrom.

The removable closure may comprise a clear section to facilitate identifying whether the intermediate compartment requires emptying of debris.

The drive means may pass at least partly through the intermediate compartment. The drive means may pass through a tunnel which passes at least partly through the intermediate compartment. The drive means may be positioned adjacent one side of the intermediate compartment.

The drive means may comprise a belt, for example a toothed belt, drive.

A wall may be provided between the rear compartment and the intermediate compartment to seal the rear compartment from the intermediate compartment.

A wall may be provided between the intermediate compartment and the forward compartment, the wall extending from the base of the intermediate compartment and terminating short of the top thereof. The top of the wall may be at substantially the same height as the top of the brush arrangement. The wall may be inclined rearwardly. The angle of inclination may be in the range of 15 to 20 degrees, for example.

The apparatus may incorporate handle means. The length of the handle means may be varied. For example, the handle means may be interchangeable. Thus, one handle means may be relatively short and another handle means may be relatively long. Alternatively, the other handle means may serve to extend the one handle means. The handle means, or at least the relatively long handle means, may be rotatable about an axial direction thereof relative to the body and/or may be pivotable about an axis transverse to the axial direction thereof to facilitate steering of the apparatus.

An auxiliary brush arrangement may be provided at one side of the body of the apparatus. The auxiliary brush arrangement may extend outwardly from the forward compartment. The auxiliary brush arrangement may rotate about an axis inclined to the vertical. The auxiliary brush arrangement may be provided with radial bristles. The radial bristles may be inclined at an acute angle to the axis of rotation of the auxiliary brush arrangement. The auxiliary brush arrangement may be driven by the electric motor or by friction.

The forward compartment includes in the lower face thereof an aperture through which bristles of the brush arrangement protrude. A front part of the forward compartment comprises the front face of the apparatus and may be movable to expose bristles at the front of the apparatus. For example, the front face may be removable or may be pivotable, or otherwise movable, to expose bristles at the front of the apparatus.

BRIEF DESCRIPTION OF THE DRAWINGS

For a better understanding of the present invention and to show more clearly how it may be carried into effect reference will now be made, by way of example, to the accompanying drawings in which.

DESCRIPTION OF PREFERRED EMBODIMENTS

Figure 1:
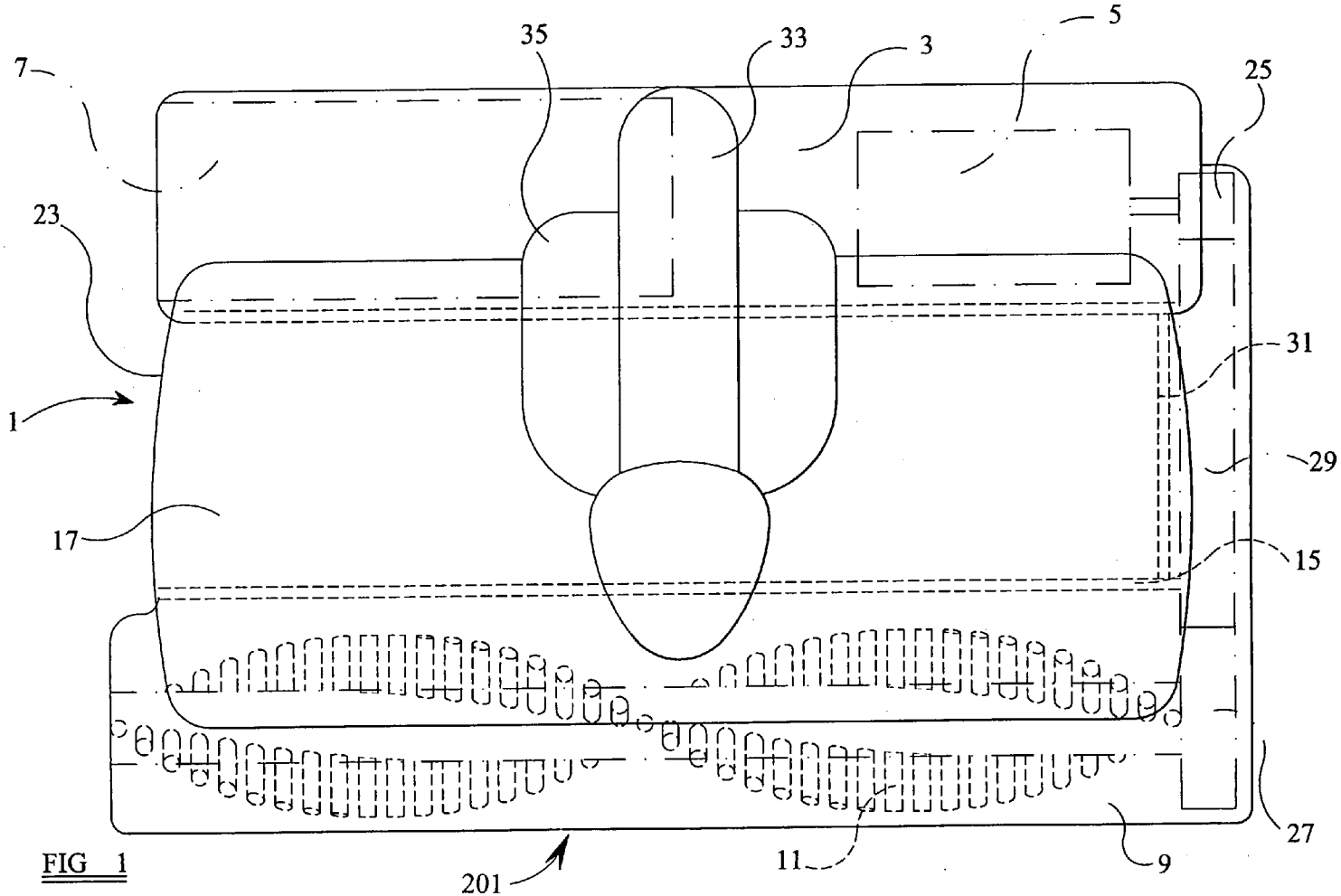
FIG. 1 is a plan view of one embodiment of a surface cleaning apparatus according to the present invention.
Figure 2:
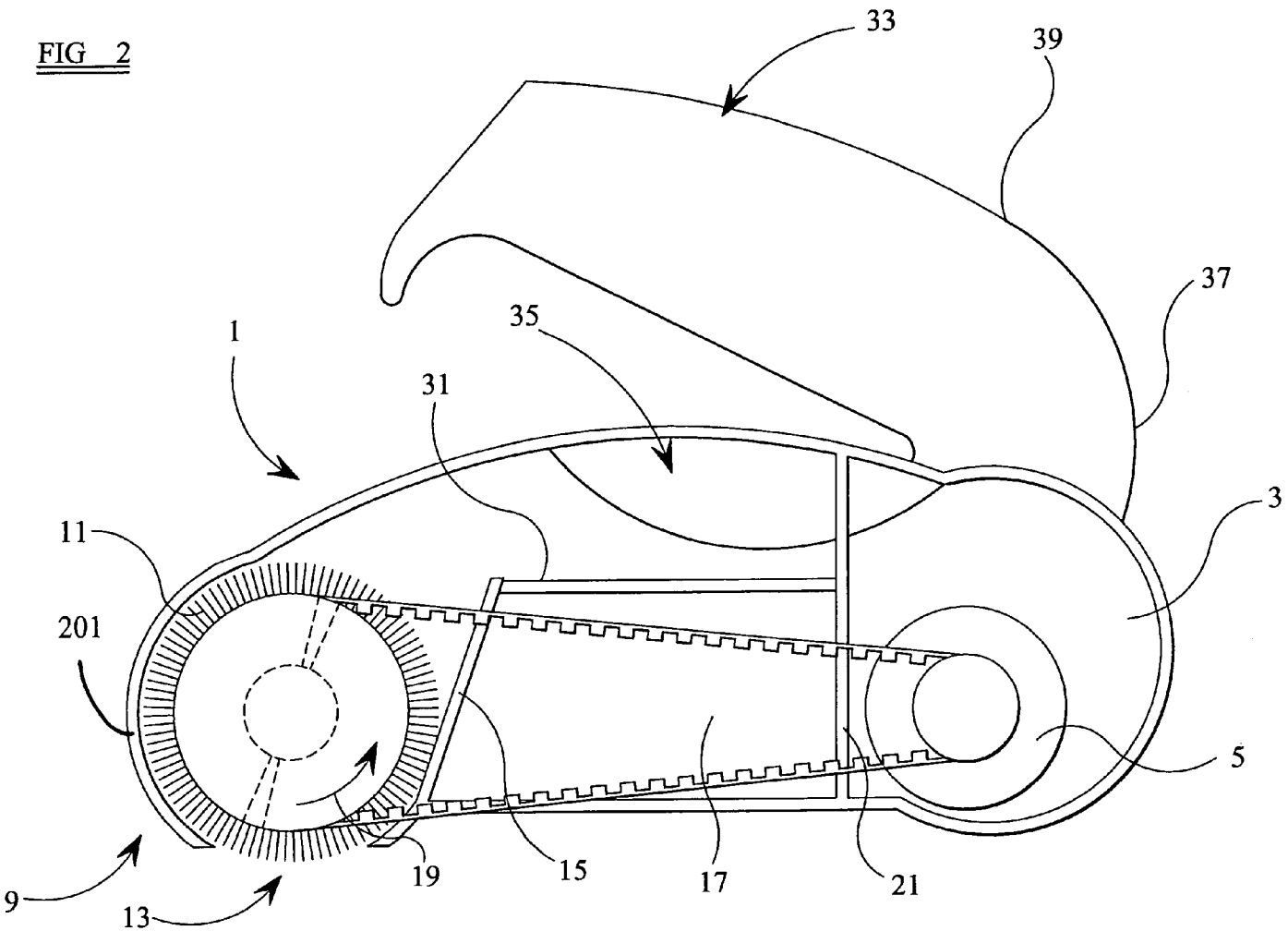
FIG. 2 is a side elevational view, partly in section, of the surface cleaning apparatus shown in FIG. 1.
Figure 3:
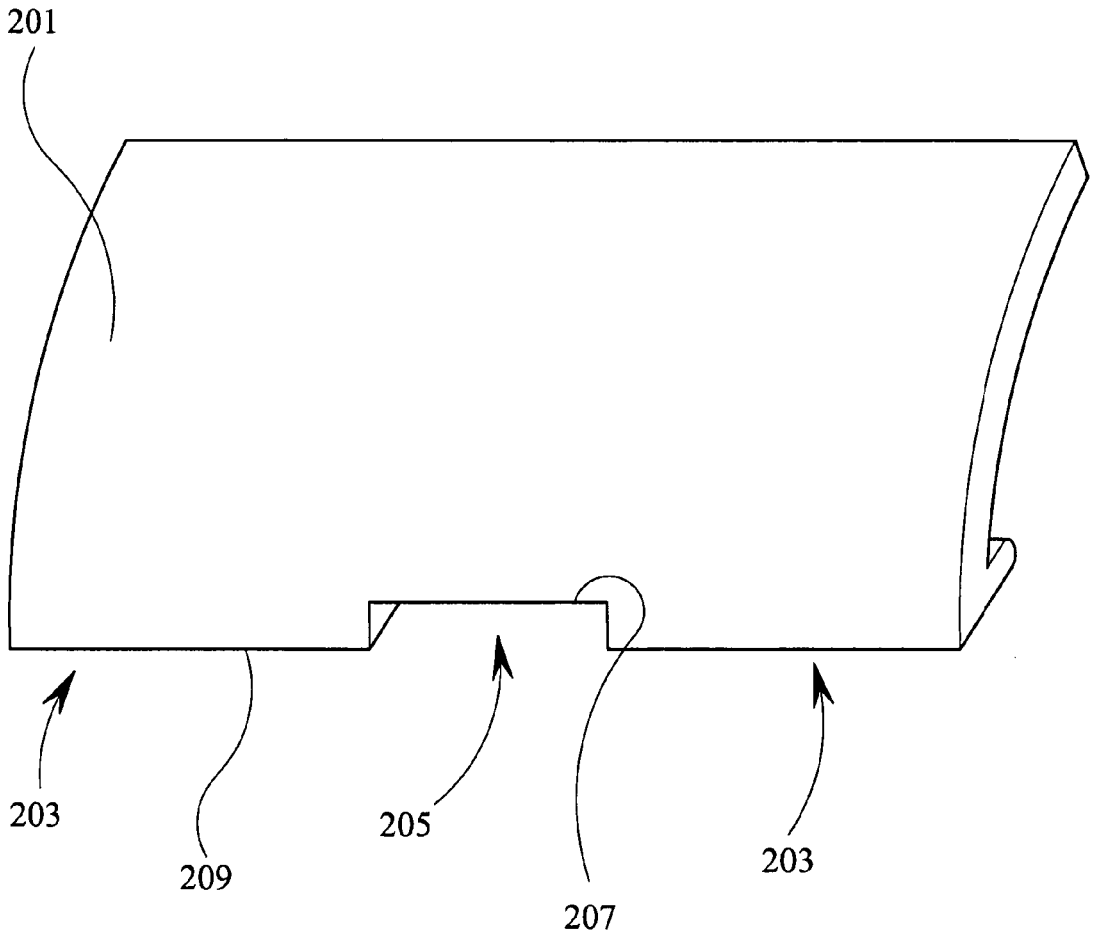
FIG. 3 is an perspective view of a front face of the surface cleaning apparatus of FIGS. 1 and 2.

The surface cleaning apparatus shown in FIGS. 1 to 3 comprises a body 1, suitably moulded of plastics material, and having effectively three compartments.

A rear compartment 3 houses an electric motor 5 and a rechargeable battery pack 7. The battery pack 7 may be connected to a mains power supply (not shown) for recharging the battery pack. The battery pack may either be connected to the mains supply whenever the apparatus is not in use or at suitable times when the battery pack has become depleted. Switch means (not shown) is provided to permit a user to energise and de-energise the motor 5 as desired. As an alternative to a rechargeable battery pack, the apparatus could employ disposable batteries or be mains powered.

A forward compartment 9 houses an elongate rotatable brush arrangement 11. The brush arrangement 11 is rotated in a direction denoted by arrow 19, such that an upper surface of the brush arrangement is rotated away from the rear compartment 3. For convenience a forward wall 201 of the forward compartment 9 is arcuate and extends around the periphery of the brush arrangement 11. The bottom of the forward compartment is open at 13 to allow the bristles of the brush arrangement to contact a floor, carpet or the like over which the surface cleaning apparatus is to be moved.

The forward wall 201 of the forward compartment comprises the front wall 201 of the surface cleaning apparatus. The lower edge 203 of the front wall 201 is non-planar, as shown in FIG. 3. The lower edge 203 incorporates a recess 205 with a width in a range from about 20 mm to about 150 mm, preferably about 60 mm. The depth of the recess, that is the distance between the top 207 of the recess 205 and the lowest portion 209 of the lower edge 203 is nominally about 10 mm but may, for example, be in the range from about 4 mm to about 20 mm. The recess allows debris, such as dust, dirt and the like, too large to pass under the lowest portion 209 of the lower edge 203 to pass into the forward compartment and be picked up by means of the brush arrangement 11. Turbulence caused by the rotation of the brush assembly, which could cause relatively small debris to be pushed along in front of the surface cleaning apparatus, is minimised as the majority of the lower edge is maintained in sufficiently close proximity to the surface to be cleaned. The distance between the surface to be cleaned and the lowest portion 209 of the lower edge 203 is nominally about 10 mm but may, for example, be in the range from about 4 mm to about 20 mm.

The rear of the forward compartment is a rearwardly inclined wall 15 which allows debris to be propelled up the wall due to rotation of the brush arrangement 11 and to pass over the wall into an intermediate compartment 17 which will be described in more detail hereinafter. The wall 15 extends upwardly to about the same height as the top of the brush arrangement 11 and is angled rearwardly (i.e. away from the forward compartment) at an angle of about 18 degrees. The precise angle is not important, but the inclination facilitates the passage of the debris up and over the wall and at the same time facilitates retention of the debris within the intermediate compartment 17. The brush arrangement extends substantially the entire width of the forward compartment and is provided with two helically arranged rows of bristles. The two rows are diametrically opposed and each row is in the form of a pair of separate helices which twist in opposite directions and meet substantially midway between the ends of the brush arrangement.

The intermediate compartment 17 is positioned between the wall 15 and a wall 21 which encloses the electrical components 5, 7 in the rear compartment 3, the wall 21 protecting the components in the rear compartment from the ingress of debris. The intermediate compartment 17 also has a lower wall, an upper wall and side walls formed by the outer wall of the body 1. Debris therefore accumulates within the intermediate compartment 17. The intermediate compartment is provided with a removable closure to facilitate the removal of debris. For example, one of the walls, such as a side wall, the upper wall or the lower wall, can be removed in order that the debris can be emptied from the intermediate compartment, the removed wall being replaced once the compartment has been emptied. The removable wall may comprise a clear section to enable a user to determine when the intermediate compartment requires emptying. Ideally, side wall 23 is removable for emptying purposes. The wall 15 provides the advantage that debris does not readily escape from the intermediate compartment 17 and, even if the body of the surface cleaning apparatus is inclined such that the forward compartment is below the intermediate compartment, the debris does not escape from the intermediate compartment.

The brush arrangement 11 is rotated by the motor 5 by way of toothed rollers 25, 27 attached to the motor and to the brush, respectively, and by way of a toothed belt 29, for example of elastomeric material, extending around the two rollers. The toothed belt 29 is enclosed within a tunnel 31 where it passes through the intermediate compartment 17 in order to prevent the ingress of debris into the rear compartment 3. The tunnel 31 may pass through the intermediate compartment 17 at any convenient point. However, particularly in the event side wall 23 is removable for emptying purposes, the tunnel may be arranged at that side of the intermediate compartment 17 remote from the side wall 23.

A handle 33 is attached to the body 1 in the region of the rear compartment 3, the body being formed with a recess 35 beneath the handle to allow the handle to be gripped while maintaining a low profile for the surface cleaning apparatus.

Figure 4:
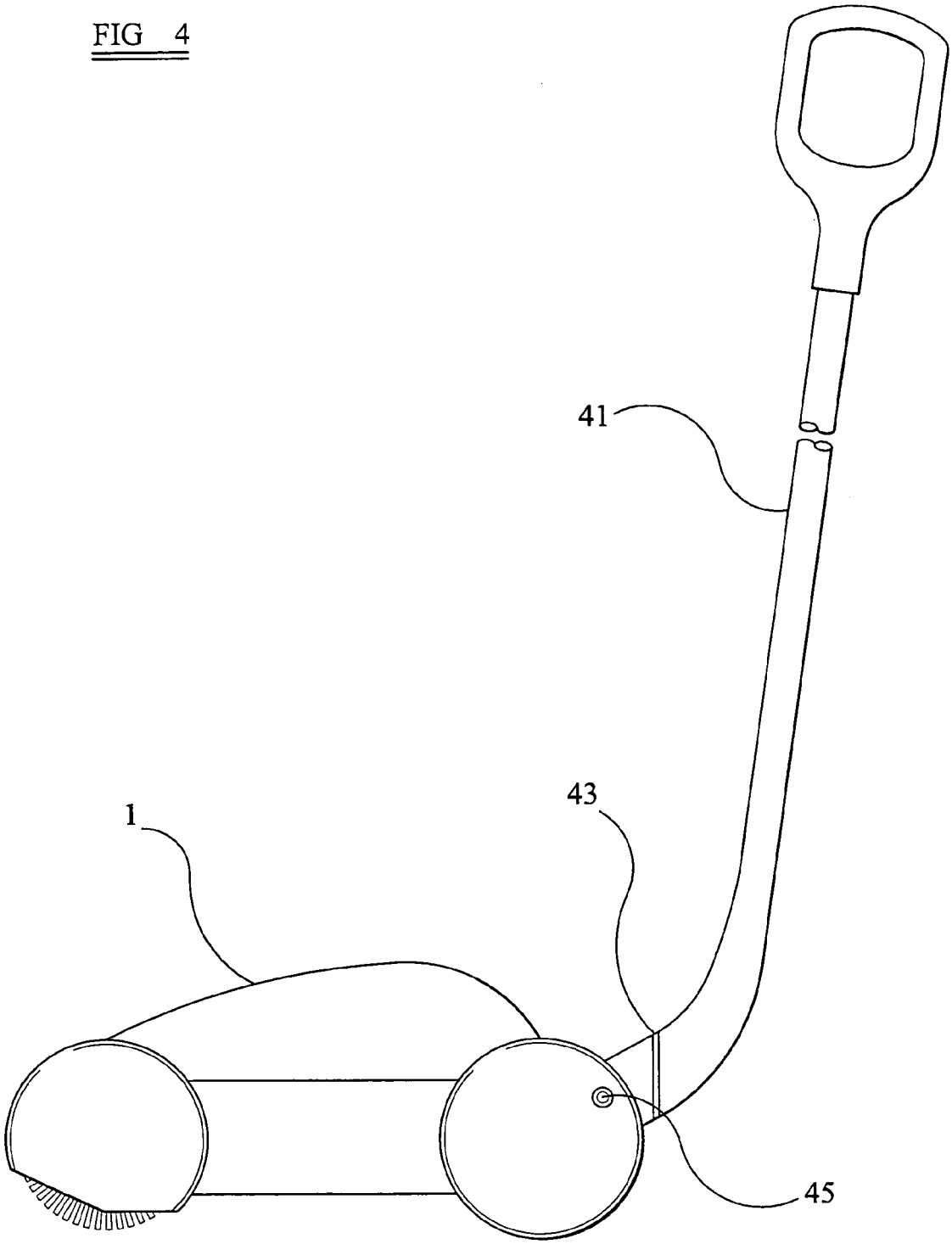
FIG. 4 is an elevational view of the surface cleaning apparatus of FIGS. 1 to 3 with an alternative handle.

The handle 33 may be in two parts, a first part 37 which is secured to the body 1 and a second part 39 which can be removed from the first part and replaced by a longer handle part 41 as shown in FIG. 4. The longer handle part 41 is provided with swivel means 43 to allow the handle part 41 to rotate about the axis thereof relative to the body 1 and with pivot means 45 to allow the handle part to pivot about an axis transverse to the axial direction of the handle part to enable the surface cleaning apparatus to be steered by the user. As an alternative to interchangeable handles, the handle part 41 may be removably engageable with the handle part 33. In such a case, the handle part 33 is arranged such that the swivel means 43 functions only in certain positions of the handle part 33 in order that movement can be inhibited when the handle part 33 is used alone.

As will be apparent particularly from FIG. 4, the bristles of the brush arrangement 11 extend outwardly from the aperture in the lower face of the forward compartment 9. In order to remove stubborn debris and/or to revitalise carpet the lower edge of the front wall of the forward compartment may be chamfered, or the front wall may be movable (including removable), to increase the exposure of the bristles in this region. In this way, the forward part of the apparatus may be inclined relative to the surface to be cleaned, thereby increasing contact between the bristles and a surface to be cleaned and, on some surfaces, increasing the depth to which the bristles penetrate and clean the surface.

Although not shown, an auxiliary rotary brush may be provided at that side of the brush arrangement 11 which incorporates the roller 27 and the belt 29. Such an auxiliary brush is described, for example, in GB-A-1 547 286. Such an auxiliary brush is able to sweep debris into the path of the brush arrangement 11 which might otherwise be missed due to the lack of bristles in the region of the roller 27. The auxiliary brush may be driven by any suitable means, such as gearing from the brush arrangement 11 or by friction with the surface to be swept, and is suspended from and extends outwardly beyond the body 1.

The auxiliary brush may comprise a cylindrical body rotatable about an axis which is inclined to the vertical by about 10 degrees so as to extend outwardly beyond the body 1. Bristles protrude radially outwardly from the periphery of the cylindrical body, but need not be perpendicular to the axis of rotation and may preferably be at an angle of about 80 degrees to the axis of rotation so as to form a cone which increases in cross-section with increasing distance from the body 1.

Although not shown, the front wall 201 of the forward compartment 9 may be removed to expose the bristles at the front of the apparatus. This effectively increases the aperture in the forward compartment which would seriously impair the effectiveness of a suction cleaner, but in the present invention can effectively be used to assist in the sweeping of stairs, cleaning upholstery and carpets in vehicles and the like operations where a greater exposed area of bristles can be useful. As an alternative to removing the front wall of the compartment 9, the front wall may be movable, for example pivotable or slidable, relative to the remainder of the compartment in order to expose the bristles.

Although not shown, the rear compartment 3 may be provided with ground-engaging wheels in order to assist mobility of the surface cleaning apparatus. The ground-engaging wheels may, for example, be formed externally in the side regions of the rear compartment 3 or may be provided within recesses formed at least partly beneath the rear compartment 3.

Although the illustrated embodiments of the present invention are intended primarily for domestic use, the surface cleaning apparatus can also be used outdoors or in workshops if desired. However, it may be preferable to provide a more rugged design specifically adapted for such use.

In use of the surface cleaning apparatus according to the invention, as shown in FIGS. 1 and 2, the apparatus is placed upon a surface to be swept, such as a carpet, and the switch operated to energise the motor and consequently to rotate the brush arrangement to sweep debris from the surface and then propel the debris up and over the inclined wall 15 and into the intermediate compartment 17 where it is temporarily stored. As the surface cleaning apparatus is moved over the surface with the brush arrangement 11 rotating, any further debris is similarly swept from the surface and propelled up and over the wall 15 and into the intermediate compartment 17. If there is a piece of relatively larger debris, the surface cleaning apparatus can be steered such that the recess in the front wall of the apparatus is passed over the larger debris and the debris is picked up by the rotating brush arrangement.

The surface cleaning apparatus is extremely portable and can be employed wherever it may be required. For example, it can be used to sweep stairs without the need for electrical leads or suction hoses. The shape of the apparatus with the rounded shape of the rear compartment as illustrated facilitates movement of the apparatus over stairs, but ground engaging wheels may be provided to further facilitate such sweeping operations.

When the intermediate compartment 17 is to be emptied, one wall of the compartment is removed as explained above and the debris can readily be discharged. The removable wall is then replaced. Alternatively, the intermediate compartment may be in the form of a tray which can be removed and emptied so as to discharge debris. The tray may comprise a section which is clear to enable a user to determine when the intermediate compartment requires emptying.

When the surface cleaning apparatus is not in use it can be stored, for example either in a cupboard or the like or plugged into a mains supply in order to recharge the battery 7.

Thus the surface cleaning apparatus of the present invention incorporates an electrically driven brush arrangement. The brush arrangement is not driven by frictional forces between the surface cleaning apparatus and the surface over which it is to be moved. Thus, efficiency of the apparatus is not dependent on the nature of the frictional contact. Further, the apparatus does not rely on suction means to draw the debris into a storage chamber. Thus, efficiency of the apparatus is not dependent on the effectiveness of suction means and the substantial power drain of suction means on the rechargeable battery is avoided. The provision of the motor at the rear of the apparatus eliminates the need for increased height should the motor be positioned over the compartment for collecting dust and the like and also provides effective full width cleaning which would not be possible if the motor was to be positioned within the compartment for collecting debris. In such a position, debris is likely to accumulate around the motor and cause blockages. The present invention overcomes this problem by passing the drive means for the brush arrangement at least partly through the debris compartment.

Figure 5:
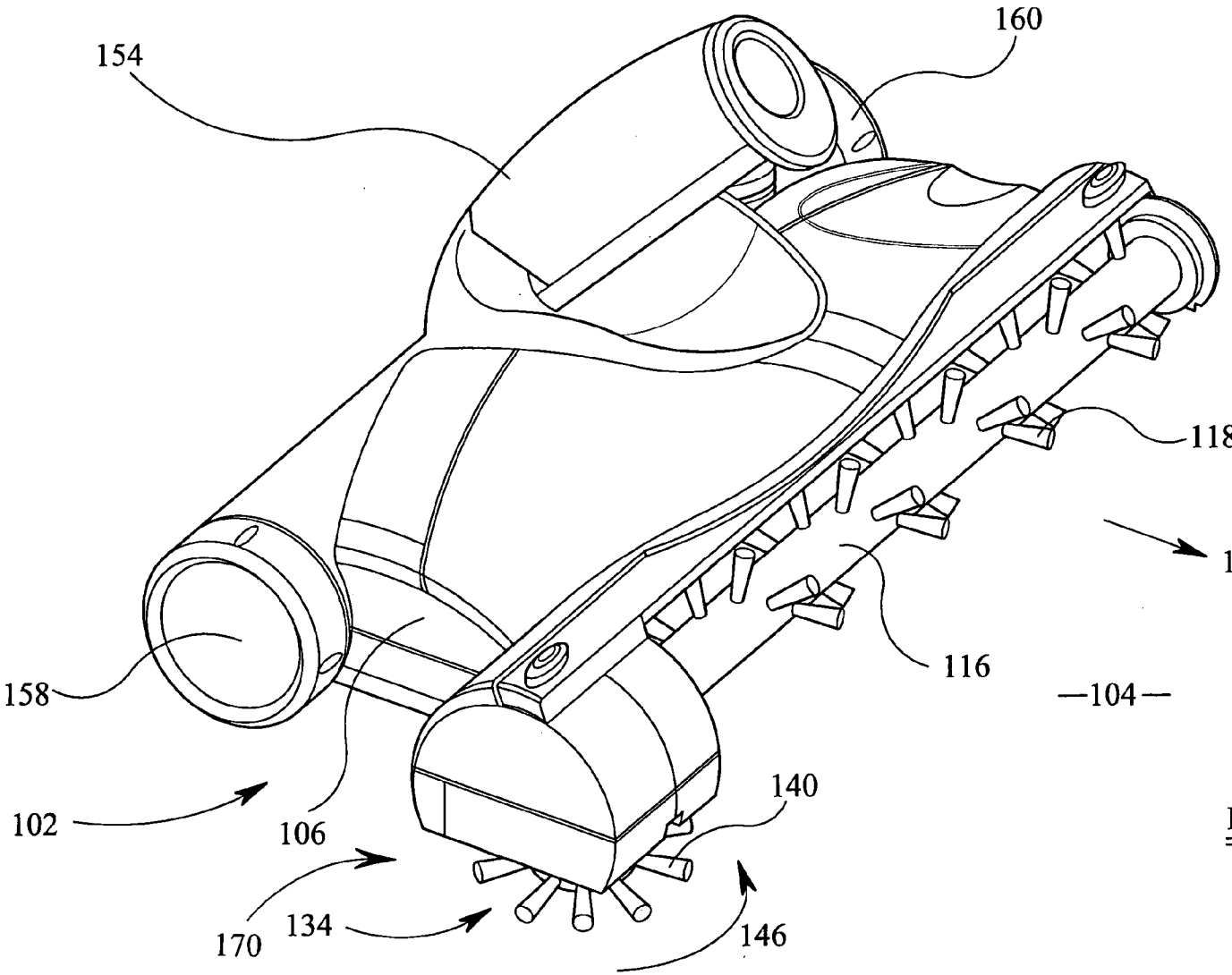
FIG. 5 is a perspective view of another embodiment of surface cleaning apparatus according to the present invention with a front face removed for clarity.
Figure 6:
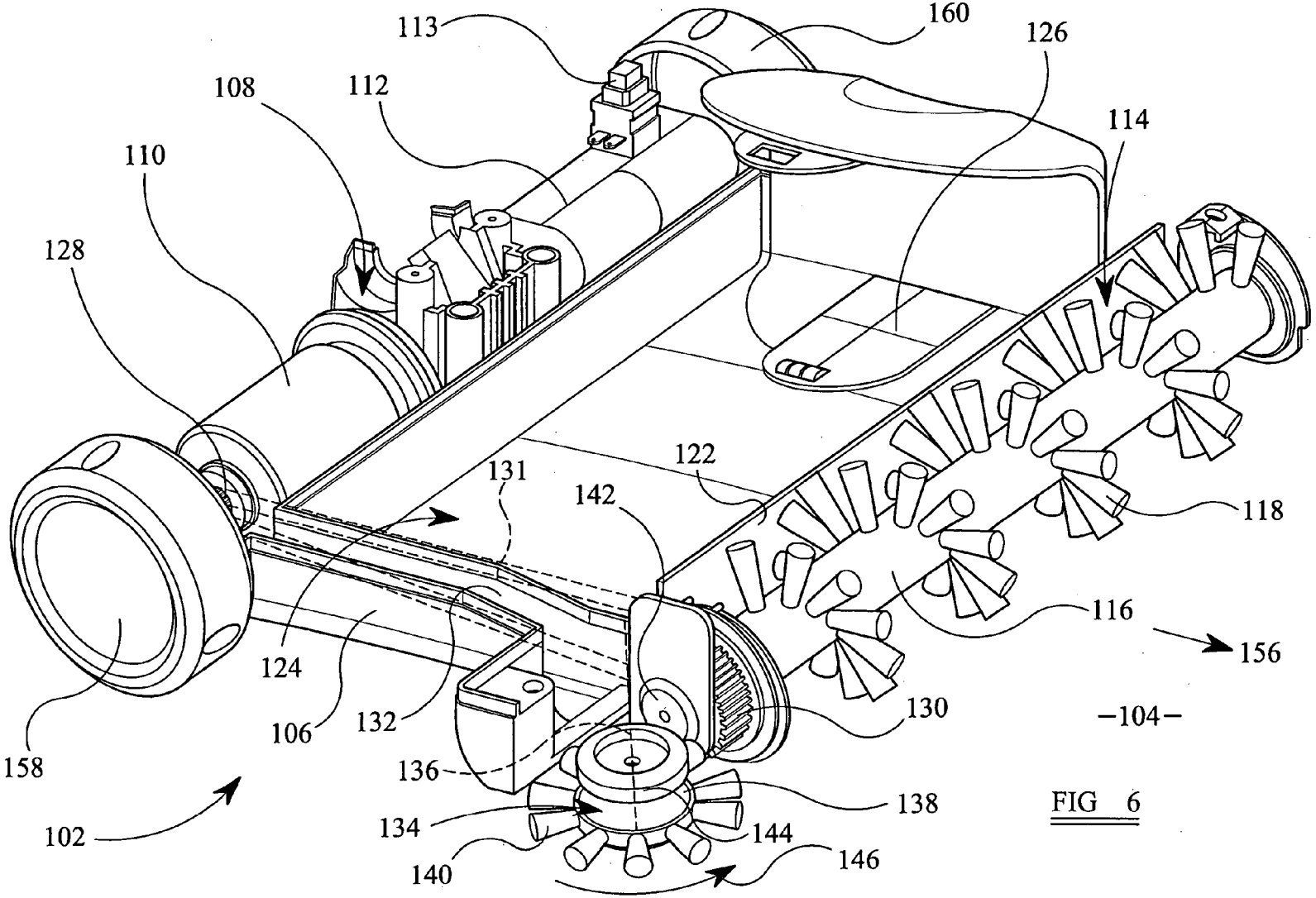
FIG. 6 is a perspective view of the apparatus of FIG. 5, with the front face of the housing thereof removed.
Figure 7:
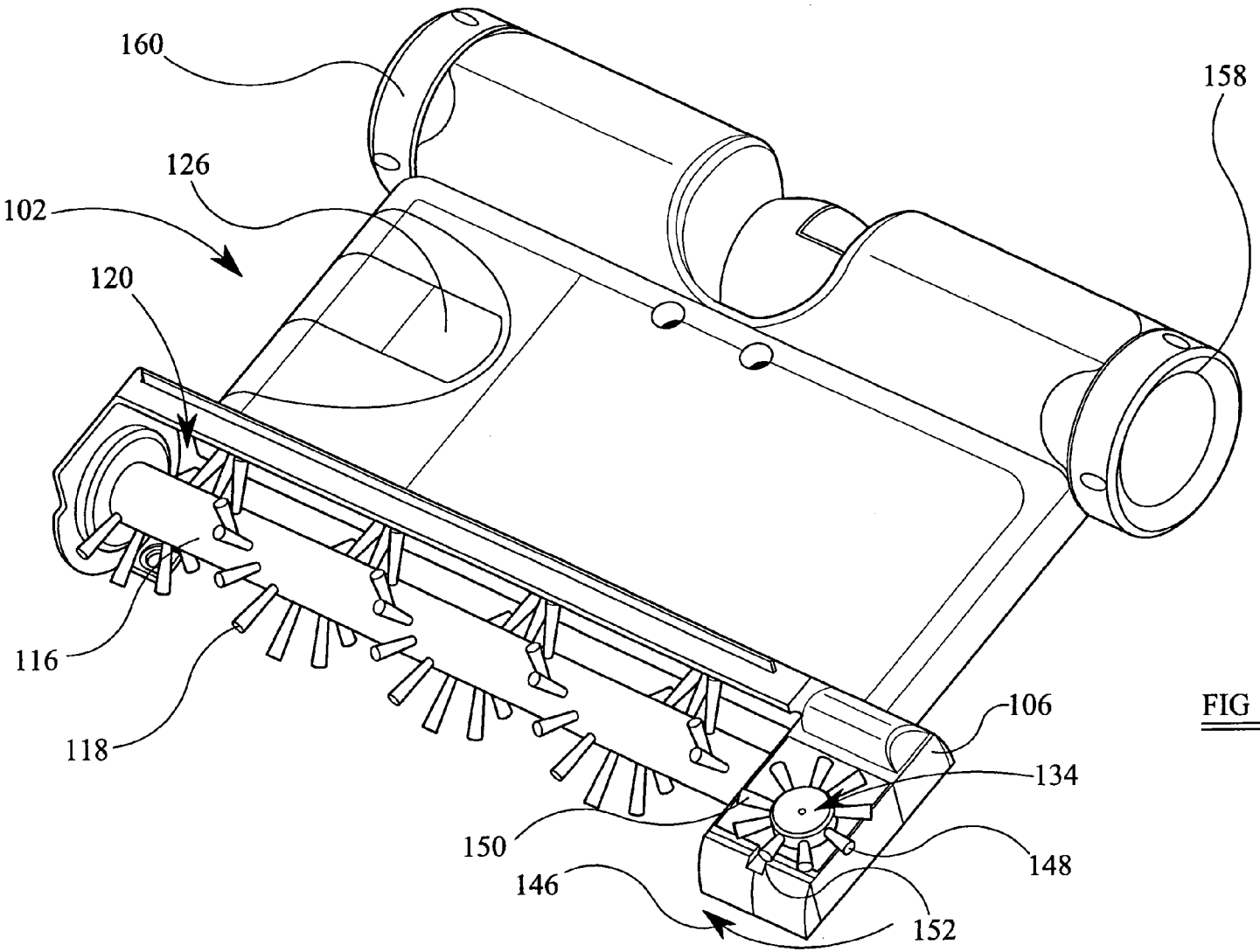
FIG. 7 is an underside view of the apparatus of FIG. 5 with the front face removed for clarity.

Referring to FIGS. 5, 6 and 7, apparatus 102 for cleaning a surface 104 by sweeping comprises a housing 106, suitably of moulded plastics material, and effectively having three compartments. A rear compartment 108 houses an electric motor 110 and a rechargeable battery pack 112. The battery pack 112 may be connected to a mains power supply (not shown) for recharging the battery pack. The battery pack may either be connected to the mains supply whenever the apparatus is not in use or at suitable times when the battery pack has become depleted. Switch means 113 is provided to permit a user to energise and de-energise the motor 110 as desired. As an alternative to a rechargeable battery pack, the apparatus could employ disposable batteries or be mains powered.

A forward compartment 114 houses a transversely-arranged elongate rotatable brush arrangement 116, with bristles 118. Such elongate rotatable brush arrangement 116 is sometimes known as a brush bar. The bottom of the forward compartment 114 is open at 120 to allow the bristles 118 of the elongate brush arrangement 116 to contact a floor, carpet or the like over which the apparatus is to be propelled. The rear of the forward compartment is a rearwardly inclined wall 122 which allows debris to be propelled up the wall due to rotation of the brush arrangement 116 and to pass over the wall into an intermediate compartment 124. The front of the forward compartment is provided with a front wall (not shown) which comprises the front face of body of the apparatus and which may be removable if desired. Debris accumulating in the intermediate compartment 124 can be removed by opening a cover 126. The wall 122 extends upwardly to about the same height as the top of the elongate brush arrangement 116 and may be angled rearwardly (i.e. away from the forward compartment) such as at an angle of about 18 degrees. The precise angle is not important, but the inclination facilitates the passage of the debris up and over the wall 122 and at the same time facilitates retention of the debris within the intermediate compartment 124.

The elongate brush arrangement 116 is rotated by the motor 110 by way of toothed rollers 128, 130 attached to the motor and to the brush arrangement, respectively, and by way of a toothed belt 131, for example of elastomeric material, extending around the two rollers. The toothed belt 131 is enclosed within a tunnel 132 where it passes through or alongside the intermediate compartment 124 in order to prevent the ingress of debris into the rear compartment 108.

An auxiliary brush means 134 is provided extending in an additional housing 170 outwardly from the apparatus housing 106 at the right hand side of the elongate rotatable brush arrangement 116 as viewed from above and behind the apparatus 102. The auxiliary brush means 134 is of substantially circular form and is supported for rotation about an axis 136, which may be vertical or inclined to vertical, such as at an angle of about 10 degrees to vertical. The auxiliary brush means 134 has a body 138 provided with radial bristles 140 which are inclined at an acute angle to the axis of rotation 136 so as to effectively form a conical arrangement increasing in cross-section with increasing distance from the body 138.

The auxiliary brush means 134 is rotatably driven from the rotating elongate brush arrangement 116 by a gear wheel 142 at the end of the elongate brush arrangement 116 which meshes with a further gear wheel 144 on the body 138 of the auxiliary brush means 134. The auxiliary brush means 134 is caused to be rotated in an anti-clockwise direction denoted by arrow 146, as viewed from above and behind the apparatus 102. During such rotation of the auxiliary brush means 134, a peripheral region thereof rotates from a sideways-directed position 148 (FIG. 7) outside the housing 106 to an opposed sideways-directed position 150 covered by the housing 106, through a forwardly-directed position 152.

The apparatus 102 is provided with a handle 154 by means of which it can be propelled at least in a forwards direction 156. Wheels 158 and 160 are provided to enable or assist manual propulsion of the apparatus across the surface 104 to be swept, such as a floor, stairway or upholstery. The handle 154 could be longer, or be of a different shape or form, as required.

The rotating auxiliary brush means 134 does not rely on contact with the surface 104 for its rotation and therefore provides more efficient sweeping of edge regions of the surface 104 regardless of the nature of the surface 104. Furthermore, the direction of rotation 146 of the auxiliary brush means 134 ensures that debris is swept positively by the auxiliary brush arrangement 134 into a position ahead of the rotating elongate rotating brush assembly 116, ready to be picked up by the elongate brush arrangement 116.

If desired, instead of or in addition to the auxiliary brush means 134 provided extending outwardly from the right hand side of the housing 106, a similar auxiliary brush means (not shown) could likewise be provided extending in an additional housing outwardly from the left hand side of the housing 106 and driven from the opposite end of the elongate brush arrangement 116. Such additional or alternative auxiliary brush means differs from the auxiliary brush means 134 only in that it is caused to rotate in a clockwise, rather than anti-clockwise, direction as viewed from above and behind the apparatus 102.

The additional housing 170 and the front wall 201 of the surface cleaning apparatus may be attached to the main housing 106 by means of clips (not shown). Therefore the additional housing 170 and the front wall 201 can be detached from the main housing 106 of the apparatus without the need for tools, to facilitate maintenance and/or repair of the elongate brush arrangement 116 and the auxiliary brush means 134.

Instead of the apparatus 102 being provided with a battery or mains powered electric motor 110 to drive the elongate brush arrangement 116 and hence the auxiliary brush means 134, a known form of friction drive means (not shown), resulting from propulsion of the apparatus 102 along the surface 104, may be utilised to effect rotation of the elongate brush arrangement 116 and hence rotation of the auxiliary brush means 134.

Although the front wall of the surface cleaning apparatus has been described as comprising a single recess such that the lower edge of the wall is non-planar it should be understood that the wall can comprise a plurality of recesses, or the lower edge can have an undulating surface such that the distance between the lower edge and the surface being cleaned can vary depending on the undulations.

What is claimed is:

1. A sweeper, comprising:

a body comprising a front face, a rear compartment, a forward compartment and an intermediate compartment arranged between the rear and forward compartments, the front face having a non-planar lower edge such that in use the distance between the lower edge and a plane of a surface to be cleaned is not uniform;

an elongate rotatable brush arrangement positioned within and extending across the forward compartment;

an electric motor positioned in the rear compartment;

and drive means extending between the rotatable brush arrangement and the electric motor, wherein the intermediate compartment is provided with a removable closure for the removal of debris therefrom, and the removable closure comprises a removable tray.

2. The sweeper according to claim 1, wherein the front face has at least one recess open at the lower edge.

3. The sweeper according to claim 2, wherein the at least one recess has a width in a range from about 20 mm to about 150 mm.

4. The sweeper according to claim 1, wherein the at least one recess has a depth in a range from about 4 mm to about 20 mm.

5. The sweeper according to claim 1, wherein a battery is positioned in the rear compartment together with the electric motor.

6. The sweeper according to claim 1, wherein the electric motor is mains powered.

7. The sweeper according to claim 1, wherein the removable closure comprises a removable side wall.

8. The sweeper according to claim 1, wherein the removable closure comprises a clear section to facilitate identifying whether the intermediate compartment requires emptying of debris.

9. The sweeper according to claim 1, wherein the apparatus incorporates handle means.

10. The sweeper according to claim 9, wherein the handle means is rotatable about the axis thereof to facilitate steering of the apparatus.

11. The sweeper according to claim 9, wherein the handle means is pivotable about an axis transverse to the axial direction thereof.

12. A sweeper, comprising:

a body having a forward compartment, an intermediate compartment for collecting debris, and a rear compartment, the forward compartment comprising a forward wall having a non-planar lower edge;

an elongate rotatable brush having bristles and extending across the forward compartment; and a belt connecting an electric motor to the rotatable brush, wherein the forward compartment further comprises an opening in a lower surface thereof, and wherein a lower front region of the body is chamfered so that bristles of the elongate brush protrude from the body in the region of the chamfer such that, when the apparatus is inclined relative to a surface to be cleaned, contact between the bristles and the surface to be cleaned is increased.

13. The sweeper of claim 12, wherein the forward wall comprises at least one recess open at the lower edge.

14. The sweeper of claim 12, wherein the forward wall of the forward compartment is movable to expose bristles on the elongate rotatable brush at a front part of the forward compartment.

15. The sweeper of claim 12, wherein the motor is located in the rear compartment.

16. The sweeper of claim 12, wherein the intermediate compartment comprises a removable tray.

* * * * *